US008243944B2

(12) United States Patent
Almagro

(10) Patent No.: US 8,243,944 B2
(45) Date of Patent: Aug. 14, 2012

(54) FOLDABLE WIRELESS VOICE MUFFLING DEVICE FOR MOBILE COMMUNICATIONS

(75) Inventor: Irving Almagro, Irvine, CA (US)

(73) Assignee: Voice Muffler Corporation, Irvine, CA (US)

( * ) Notice: Subject to any disclaimer, the term of this patent is extended or adjusted under 35 U.S.C. 154(b) by 529 days.

(21) Appl. No.: 12/583,298

(22) Filed: Aug. 17, 2009

(65) Prior Publication Data

US 2010/0135504 A1 Jun. 3, 2010

Related U.S. Application Data

(60) Provisional application No. 61/089,095, filed on Aug. 15, 2008.

(51) Int. Cl.
*H04R 3/02* (2006.01)

(52) U.S. Cl. .... 381/73.1; 381/71.7; 381/355; 455/575.3

(58) Field of Classification Search ..... 381/77–79, 381/87, 334, 71.1–71.3, 71.7, 355, 369; 379/430, 379/447, 444, 441; 455/575.1, 575.3, 575.8; 181/175, 21, 242
See application file for complete search history.

(56) References Cited

U.S. PATENT DOCUMENTS

| | | | | |
|---|---|---|---|---|
| 7,197,140 | B2 * | 3/2007 | Asaro | 379/433.03 |
| 7,515,708 | B1 * | 4/2009 | Doty et al. | 379/440 |
| 2004/0259602 | A1 * | 12/2004 | Zack | 455/570 |

* cited by examiner

*Primary Examiner* — Vivian Chin
*Assistant Examiner* — Friedrich W Fahnert

(57) ABSTRACT

A handheld foldable voice-muffling device using passive noise silencing materials to dampen noise and a microphonic transceiver to transmit a user's speech and receive incoming signals allowing him to wirelessly communicate with another person or other communication devices without causing a disturbance to others in his surrounding area.

20 Claims, 5 Drawing Sheets

FOLDABLE WIRELESS VOICE MUFFLING DEVICE FOR MOBILE COMMUNICATIONS

RELATED APPLICATION

This application claims priority date under 35 U.S.C.sctn. 119(e) from the following U.S. provisional application: Application Ser. No. 61/089,095, titled "Foldable Wireless Voice Muffling Device for Mobile Communication," filed on Aug. 15, 2008.

BACKGROUND OF THE INVENTION

The present invention relates generally to wireless communications, voice recognition devices, and more particularly to the passive muffling of undesirable extraneous sounds produced when a person talks into an electronic communication device such as cellular, mobile, wireless or wired phone and other devices with microphones.

The Reporting Device that was patented over 20 years ago in U.S. Pat. No. Gore, 4,129,754 provided a viable solution in reducing undesirable sounds when using a microphone in ruckus adverse environments such as courtrooms. The problem with this prior art is that the device uses a cable to connect the audio signals to an audio processor which can be very inconvenient.

There are currently numerous devices with a transceiver that facilitates wireless communication from a person speaking into a microphone, particularly the now ubiquitous cellphones or mobile phones. These devices however are causing a public nuisance especially inside buses and trains, not to mention the loss on the uses privacy.

Bluetooth wireless technology is a short-range communications technology intended to replace the cables connecting portable and/or fixed devices while maintaining high levels of security. WiMAX, LTE and similar broadband technology provide long range telecommunications for portable devices. WiFi and Wireless USB technology facilitate the telecommunications of voice and data signals to computer systems. UHF, VHF, microwave and other radio transceiver technologies convert and reproduce audio and digital signals into radio waves to facilitate telecommunications.

Thus, embedding a Bluetooth, WIFI, WiMAX, Wireless USB or other wireless RF transceiver inside a foldable device with a removable sound absorbing interior housing and a microphone positioned outside or inside of said interior housing would provide someone speaking into a microphone a convenient, quieter, more hygienic and effective telecommunications capability.

OBJECTS OF THE INVENTION

It is therefore an object of the invention to provide a device that can substantially muffle unwanted vocal sounds from people speaking into devices with microphones and can utilize the Bluetooth or similar wireless systems in conveying the audio signals to telecommunications devices such as cellular, mobile, PBX, Voice Over IP, etc., thereby eliminating cords or cables which can entangle and interfere with the operator's movements.

A further object of the invention is to provide a wireless voice muffler that can effectively eliminate unwanted sounds by incorporating a removable interior housing or baffle component.

A further object of the invention is to provide a wireless voice muffler for office employees who need privacy when conversing on the phone while also reducing the noise nuisance and distraction in their workplace, benefiting employers.

A further object of the invention is to provide a wireless voice muffler for musically inclined and aspiring singers who wish to practice singing while in public venues.

A further object of the invention is to provide a wireless voice muffler for use inside airplane cabins, buses, trains or other transportation systems for passengers who do not like to listen to conversations from other passengers seated nearby.

A further object of the invention is to provide a wireless voice muffler that can provide a clear and consistent audio signal output that can be fed to a speech or voice processing system to perform functions such as voice to word or text processing and other audio processing applications.

A further object of the invention is to provide a wireless voice muffler that can easily be cleaned and sanitized.

A further object of the invention is to provide a wireless voice muffler that can be attached to a lanyard for easy transportability.

SUMMARY OF THE INVENTION

In one exemplary embodiment, the present invention is having a generally rigid housing defining a clamshell that a user grasps and manipulates, whereby said clamshell comprises: a formable interior housing having a hollow shape with a closed end and a wide open end that covers a user's mouth area, a microphone and a transceiver.

The invention is generally used as a mobile phone accessory, more particularly in situations whereby the user does not want to disturb someone close by when he is making a phone call or he does not want his privacy compromised. The user operates the device by first opening the exterior clamshell housing to expose the hollow sound absorbing interior housing whereby it is manipulated to generally cover the mouth area of the user to prevent as much vocal noise from escaping out into the user's vicinity. When the device is opened, the transceiver system gets activated thereby allowing the microphone to receive a user's speech wherein said speech is processed and sent to remote audio processors, such as a mobile phone. The user receives incoming signals from the aforementioned transceiver system in combination with an earphone or earpiece. When the user decides he longer needs to use the device, he simply folds it up and stores it into his pocket.

DETAILED DESCRIPTION OF THE PREFERRED EMBODIMENT

Figure 1:
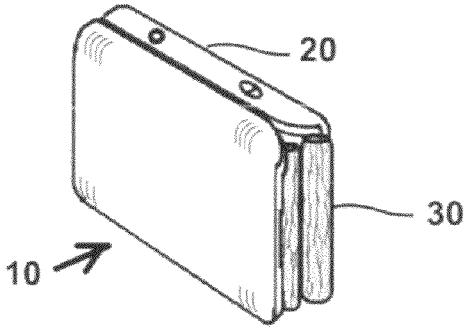
FIG. 1 is a perspective view of an embodiment of the invention shown in a nested arrangement.

As used herein, the term "housing" is intended, but not limited, to generally refer to a metallic or non-metallic or a combination of both, protective cover, casing, case, shell or enclosure designed to contain, enclose or support another housing, mechanical, electrical, electronic components, and/or any combination thereof. It can be homogeneous, heterogeneous, multi-layered, multi-bodied, multi-frame, multi-colored and/or any combination thereof. It may be rigid, semi-rigid, flexible, supple, and/or a combination thereof. It may also have properties such as sound absorbing, sound-proofing, sound muffling, sound baffling, sound distorting, anti-bacterial, germicidal, anti-viral, anti-odor, and/or a combination thereof.

As used herein, the term "transceiver," or "personal transceiver," or "transceiver system," or "transceiver unit," or "transceiver module," is intended but not limited, to generally refer to a full-duplex, wireless or radio frequency system having electronic components and circuitry such as a transmitter, receiver, CODEC, DAC, Advanced RISC Machine (ARM) CPU, application processor, memory, sound quality optimizer, telephone number dialing circuitry, antenna, power supply, battery, battery charger, timer, test and monitoring circuitry, amplifier, video circuit, digital and analog processors, AF or RF signal conditioners, automatic volume or gain control circuitry, active noise cancelation electronics, other associated mechanical, electronic and electrical components, and/or any combination thereof, the main function of which is: to transmit analog and/or digital signals; or to receive analog and/or digital signals; or a combination thereof: The transmission and reception mode of a transceiver can also be simplex, half-duplex or multiplex. As a Personal Computer (PC) may refer to a computer system comprising of dual processors; peripherals such as keyboards, monitors, sound cards having microphone input and loudspeaker outputs, amplifiers; and software, a personal transceiver may likewise refer to a combination of dual channel transceiver chips with peripherals, amplifiers and software to become functional. Further, software programs such as voice recognition, speech-to-text, text-to-speech, active noise cancelation, and/or a combination thereof, can be part of a transceiver for it to become functional. In a language translation adaptation, an image or video processor may also be integrated into the transceiver to allow a remotely located interpreter get a better grasp of the user's surrounding, thereby effecting a more accurate translation. Further, in an active noise cancellation adaptation, the transceiver can additionally comprise of a microphone, amplifier and loudspeaker components to reduce undesirable soundwaves by feeding back a 180 degree phased signal of the original soundwaves to cancel out the original soundwaves. It should be further understood that it is a common practice in the electronics industry to use expansion slots, adapters, sockets, connectors, and/or any combination thereof, with the goal of providing robustness and extensibilty of the transceiver by adding enhancement capabilities and new functionalities of their hardware products. Some components of the transceiver do not necessarily have to stay enclosed within the module for it to qualify as a transceiver. For example, to lengthen the transceiver's usage, a battery pack can be added, and to extend its range a RF amplifier and longer antenna can be added, externally. Other examples include SIM cards, SD memory cards, CF memory cards, amplifiers, firmware ROMs, etc. These additional components are associated with the transmitting and receiving functions and are therefore considered integral parts of the "transceiver" and thus may not need to be specified as separate components. Further, due to the rapid advances in the semiconductor industry with regards to miniaturization, it is further understood that more and more discrete components are being integrated and made modular therein. For example, previous PC practitioners refer to the CPU as just the computer chip, and related supporting circuits such as a digital communications controllers I/O controller, firmware. ROM, timing circuits, cache controller, were considered separate or discrete components. Nowadays, however, the CPU refers to of all these formerly discrete components as part of the computer chip integrated or modularized into a single chip or module. Similarly, the transceiver has been constantly transitioned into a modularized structure and therefore it is understood that the term also encompasses, but not limited, to the integration and modularization of discrete components that relate to the function of transmitting and/or receiving analog/digital signals. Further, wireless base stations are also considered as transceivers since their main function is to transmit and receive data in addition to signal processing and conditioning.

As used herein, the term "multifunction key," or "multi-key" is intended, but not limited, to generally refer to a push button switch which allows the invention to be powered up or powered down, pair with compatible wireless devices, run a self-test or bootup routine, as well as other tasks associated with the efficient functioning and high performance of the transceiver system. The multi-key starts up and maintains the process of getting power to the transceiver from the power source, typically a battery, or starting a standby timer which powers down the transceiver after a set period of time, a function also known as auto-shutoff used for conserving the device's battery. This key can also power down the device when the user depresses it for a few seconds. Additionally, this key is also associated or integrated with small indicator lamps which provide status information of the wireless device. It is understood that new functions are continually added to this component to enhance the transceiver's capabilities, so implementing these enhancements on the present invention would be embraced and considered as a normal progression or transition of its technology.

As used herein, the term "microphone" is intended, but not limited, to generally refer to a device or an instrument that converts sound waves into an electric current, usually fed into a sound processor, an amplifier, a recorder, or a broadcast transmitter. It can be any type depending upon the manufacturer's or the user's preference—whether it be sound quality, noise canceling capability, weight and/or cost consideration, size, ruggedness, and/or a combination thereof. It is understood that the microphone technology is constantly evolving and improving which therefore makes it very conceivable that the microphone used in the present invention may adopt all the aforementioned enhancements and/or improvements thereof.

As used herein, the term "battery" is intended, but not limited, to generally refer to a A direct-current voltage source made up of one or more units that convert chemical, thermal, nuclear, mechanical or solar energy into electrical energy. It can be disposable but it is preferred that the present invention uses a rechargeable type. If it is of the rechargeable type, the term "battery" may refer to a rechargeable battery with its related charging circuitry which comprise an AC adapter, a rectifier, a passive filter, an active filter, a timer, an overcharging protector, and/or a combination of other related battery recharging electronics. It is understood that the battery technology is constantly evolving and improving, therefore the type or kind of battery that the present invention may adopt will depend on the application's or manufacturer's preference.

Figure 2:
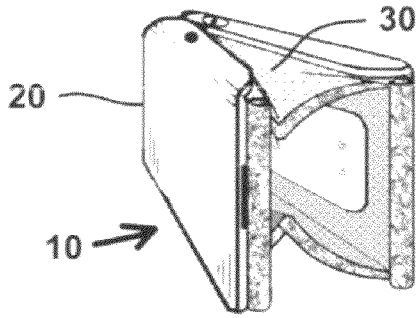
FIG. 2 is a perspective view of an embodiment of the invention shown in a partially extended arrangement.
Figure 3:
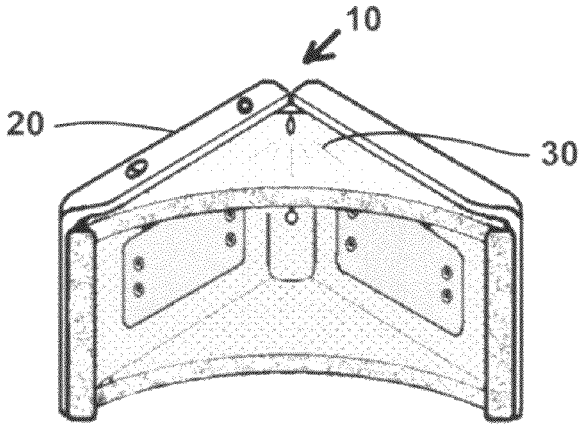
FIG. 3 is a perspective view of an embodiment of the invention shown in an extended arrangement.

FIGS. 1-3 show the different views of the present invention seen as general reference 10 comprising of an exterior housing component 20 and a deformable interior housing component 30. As can be seen in FIGS. 2 and 3, a hollow interior housing 30 is exposed when the exterior housing 20 is opened and extended outward. FIGS. 5 through 9 show the detailed views of the exterior housing 20 and FIGS. 10 through 15 show the detailed views of the interior housing 30.

Figure 4:
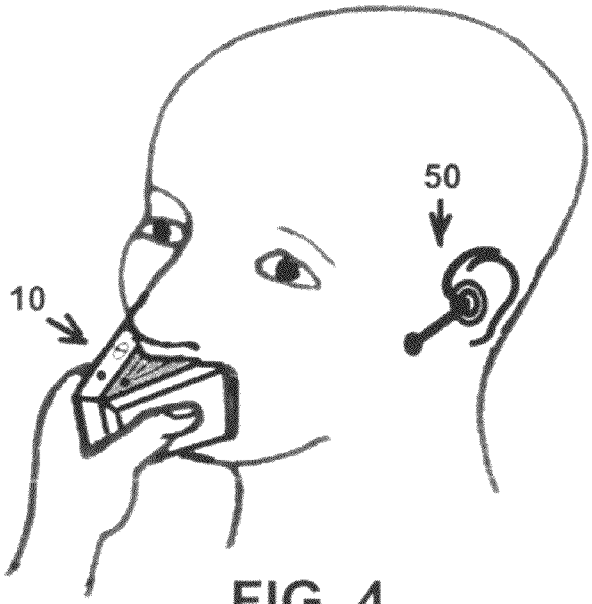
FIG. 4 is a pictorial representation of how a person would typically use the device in accordance with an embodiment of the invention.
Figure 5:
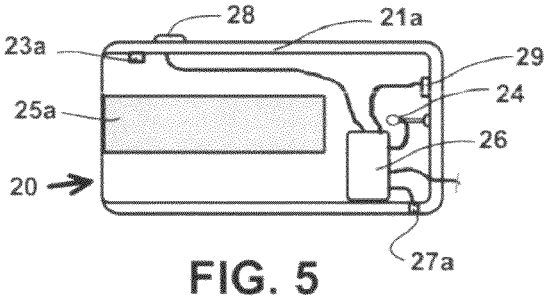
FIG. 5 is a side elevational view of an embodiment of the invention showing the left part of the exterior housing assembly.
Figure 6:
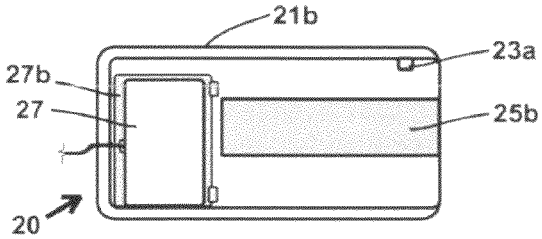
FIG. 6 is a side elevational view of an embodiment of the invention showing the right part of the exterior housing assembly.
Figure 7:
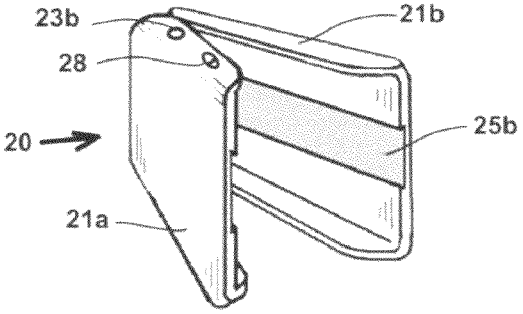
FIG. 7 is a front perspective view of an embodiment of the invention showing the exterior housing in a partially extended arrangement.
Figure 8:
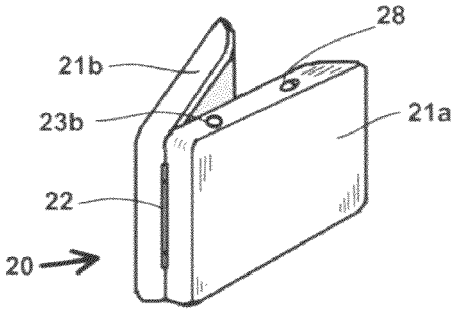
FIG. 8 is a rear perspective view of an embodiment of the invention showing the exterior housing in a partially extended arrangement.
Figure 9:
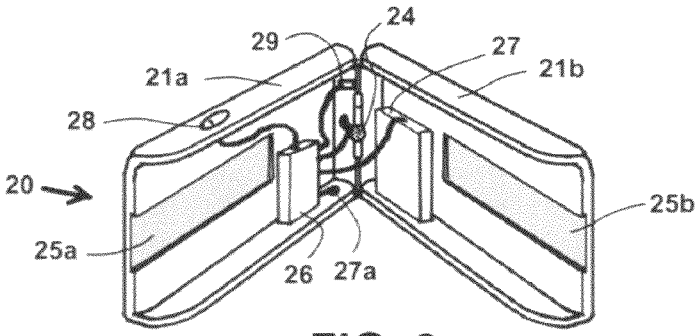
FIG. 9 is a perspective view of an embodiment of the invention showing the exterior housing in an extended arrangement.

FIG. 4 illustrates a user manipulating the present invention 10 by pressing it against his/her face with just the proper amount of pressure to effect a seal of any undesirable sounds when talking into the microphone 25 embedded within the device 10. A wireless headset, earphone, or earbud 50 is typically used in combination or association with the transceiver 26 of device 10 to allow the user to hear or listen to the incoming signals. As well, the user may use the speaker of the mobile phone 60 to listen to the call. Alternatively, a wired earbud or earpiece or earphone may be used or supplemented with the device 10 to reproduce the incoming calls.

As shown in FIGS. 5-9, the exterior housing 20 comprises two crush-proof shells, a first shell 21*a* and a second shell 21*b*, both of which are generally of the same size and shape, coupled rotatably by a hinge 22 thereby forming a clamshell configuration that is dimensioned to fit a user's hand comfortably which means they can be in different sizes such as small, medium, etc. When the device 10 is not being used, a mechanical latch 23*a*, preferably magnetic, may be used to secure the first shell 21*a* to the second shell 21*b*. Another preferred embodiment would be the use of a hinge 22 that is spring-loaded such as those used in some eyeglass cases, thus eliminating the need for said latch 23*a*. Alternatively, a locking or latch system with a latch release mechanism may be implemented instead of the mechanical latch 23*a* or spring-loaded hinge 22. Such alternative latch arrangement can consist of mechanical linkages such as springs, rods, hooks, and pivots whereby a pushbutton 23*b*, located on the exterior of the interior housing 30, when depressed disengages a hook that secures the shells 21*a* and 21*b* together, allowing the device 10 to swing open. Closing the device 10 engages a hook assisted by a spring therein.

Further, the first shell 21*a* of the exterior housing 20, may comprise a microphone 24, a transceiver 26, a multi-key 28, an open/close sensor 29, and/or combinations thereof. Microphone 24, which can alternatively be located inside the interior housing 30, accepts the speech from a user, whereby its output signal is fed to the transceiver 26, which then processes and transmits the RF signal to a remote device such as a cellphone 60, a headset 50 or a speech processing system via a base station 70, and/or a combination thereof. It is also understood that in some enhanced embodiment of the invention, a microphone 24 may be added to condition the audio signal and may be located inside, or outside, or a combination thereof, of the inner housing 30. The aforementioned audio signal conditioner may be a separate circuit component of the transceiver system 26 or may also be integrated into the transceiver system 26 itself. In order to minimize the echo that gets generated by the device 10, the microphone can be placed on the exterior part of the housing 20 although the use of an echo canceling microphone is more preferable.

An easily removable primary or auxiliary battery 27, may be located in an appropriate area of the exterior housing 20 such as on the second shell 21*b*. This can be implemented by incorporating a battery compartment cover 27*b* that slides out when a release button is depressed, exposing the battery 27. A socket 27*a* for an AC adapter plug may be provided for those devices that use rechargeable batteries.

The switch or sensor 29 is normally open electrically when the device 10 is folded up or is not being used, and causes the circuitry in the wireless transceiver 26 to place the device 10 into a standby or suspended mode. The device 10 stays in the standby mode until the system times out and powers the system down due to inactivity, the length of such inactivity being usually dependent on the preset auto shutoff feature of the transceiver system 26, or until the user decides to manually power down the device 10, in which case such shutdown condition is accomplished by keeping the multi-key 28 continuously depressed for a few seconds.

When the device 10 is opened or unfolded, such as making or answering a call, sensor 29 detects the changed state and electrically closes the open circuit causing the device 10 to switch to an operational mode thereby allowing the microphone to accept the user's voice which consequently sends the output signal to a remote device for processing.

Channel grooves 25*a* and 25*b* are provided on corresponding shells 21*a* and 21*b*, located on the exterior housing 20, to match with the thin panel rails 36*a* and 36*b*, located on the interior housing 30, to allow the interior housing 30 to slide in and out of the exterior housing 20 for easy removal. It is also preferable that some other mechanical means be used to secure the interior housing 30 to the exterior housing 20, for example using clamps, glue, tape, screws and bolts.

Figure 14:
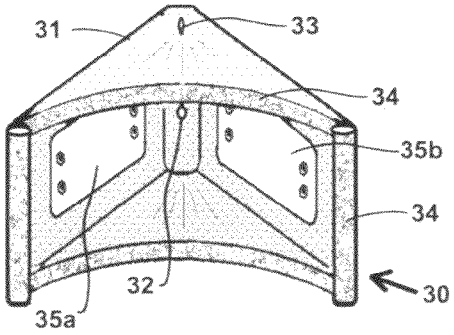
FIG. 14 is a front perspective view of an embodiment of the invention showing the interior housing in an extended arrangement.
Figure 15:
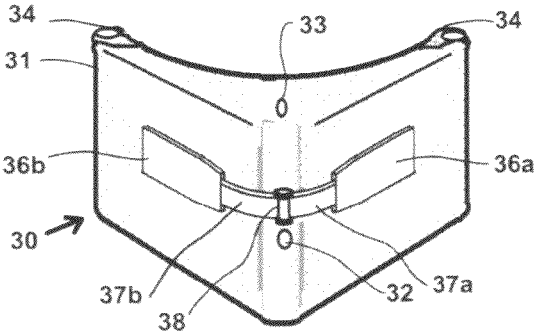
FIG. 15 is a rear perspective view of an embodiment of the invention showing the interior housing in an extended arrangement.

FIGS. 14 and 15 are the front and rear views of the deformable interior housing 30, having a sound absorbing or sound suppressing or noise eliminating material 31, further seen as generally having a hollow triangular prism shape, comprising a wide open end and a narrow closed end, whereby the upper and lower portions of the wide open end are arced to conform to the shape of the facial area around the user's mouth, and the narrow closed end comprises: an appropriate opening 32 for the microphone to capture the speaker's voice; and a vent 33, located in close proximity of said closed end. A foam or gel filled or a generally soft material 34 may be incorporated or attached along the brim of the wide open end for user comfort. Additionally, the deformable material 31 may have anti-bacterial, antiseptic, anti-viral, anti-fungal, anti-odor, anti-microbial, germicidal, or a combination thereof, properties to improve hygiene. Such substances may be layered, or coated, or lined, or imbedded, or a combination thereof, into the deformable material 31. Alternatively, a disposable germicidal liner or foam may be implemented to allow for the convenient elimination of harmful bacteria. Vent 33 releases the pressure build-up within the device to allow for better recordation of the user's voice.

Figure 10:
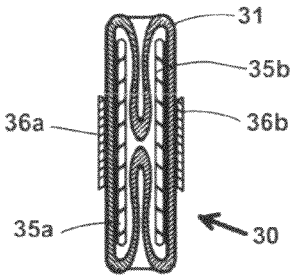
FIG. 10 is a front sectional view of an embodiment of the invention showing the interior housing in a folded arrangement taken along line A-A of FIG. 11.
Figure 11:
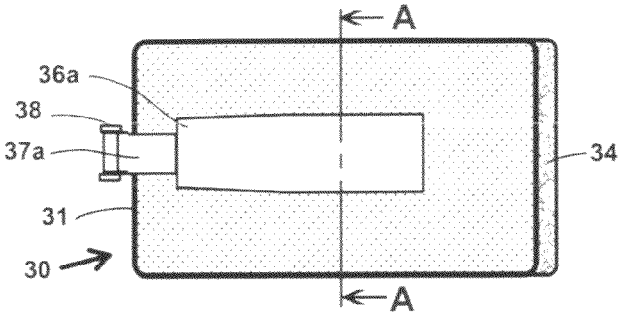
FIG. 11 is a side elevational view of an embodiment of the invention showing the interior housing in a folded arrangement.
Figure 12:
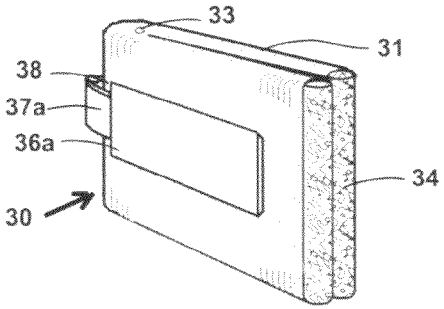
FIG. 12 is a perspective view of an embodiment of the invention showing the interior housing in a folded arrangement.
Figure 13:
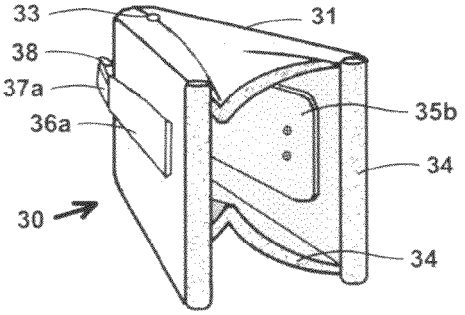
FIG. 13 is a perspective view of an embodiment of the invention showing the interior housing in a partially folded arrangement.

FIG. 10 shows a cross sectional view of the interior housing 30, approximately halfway between the front and the rear, illustrating how it would look like when it is folded up. On the left side of the housing 30, it is seen that the outside rail 36*a* secures the deformable material 31 by means of a bolt or screw to a rigid flat panel 35*a* located inside said material 31, which is generally larger in size compared to the rail 36*a*. A similar arrangement is effected on the right side of the housing 30 by the corresponding outside rail 36*b* and inner panel 35*b*. The outside rails 36*a* and 36*b* have slanting shapes which correspond to the slanted grooves 25*a* and 25*b* located on the exterior housing 20, said rails are slightly tapered to allow for the interior housing 30 to transition nicely as it slides and seats inside the exterior housing 20, said rails are further attached to corresponding slightly curved flat brackets 37*a* and 37*b* that are joined rotatably by a hinge 38 which help stabilize the slidable structure, thus facilitating the cleaning, repair, or replacement of the interior housing 30 thereof.

Alternatively, the interior housing 30 may be integrated or attached to the exterior housing 20 by other mechanical attachment means such as clamps, screws, glues, nuts and bolts, etc. As previously mentioned, the microphone 24 may be located inside the interior housing 30 instead of outside, in which case the electrical connections to said microphone may be supported by running, the electrical connections from the microphone along electrical contacts embedded or surface coated on the outside rails 35*a* and/or 35*b* whereby they physically and electrically link with the exterior housing 20 circuits through electrical contacts embedded or surface coated on the corresponding grooves 25*a* and/or 25*b* as they abut up against each other. As a further alternative, electrical connections from said microphone can be routed and terminated by a connector plug at the distal end of the interior housing 30, whereby said connector plug inserts into a corresponding jack located on the exterior housing 20. It is also understood that in some enhanced embodiment of the invention, a microphone 24 may be added that can condition or improve the clarity of the audio signal and may be located inside, or outside, or a combination thereof, of the inner housing 30. Said audio signal conditioner may be a separate circuit component of the transceiver system 26 or may also be integrated into the transceiver system 26.

Figure 16:
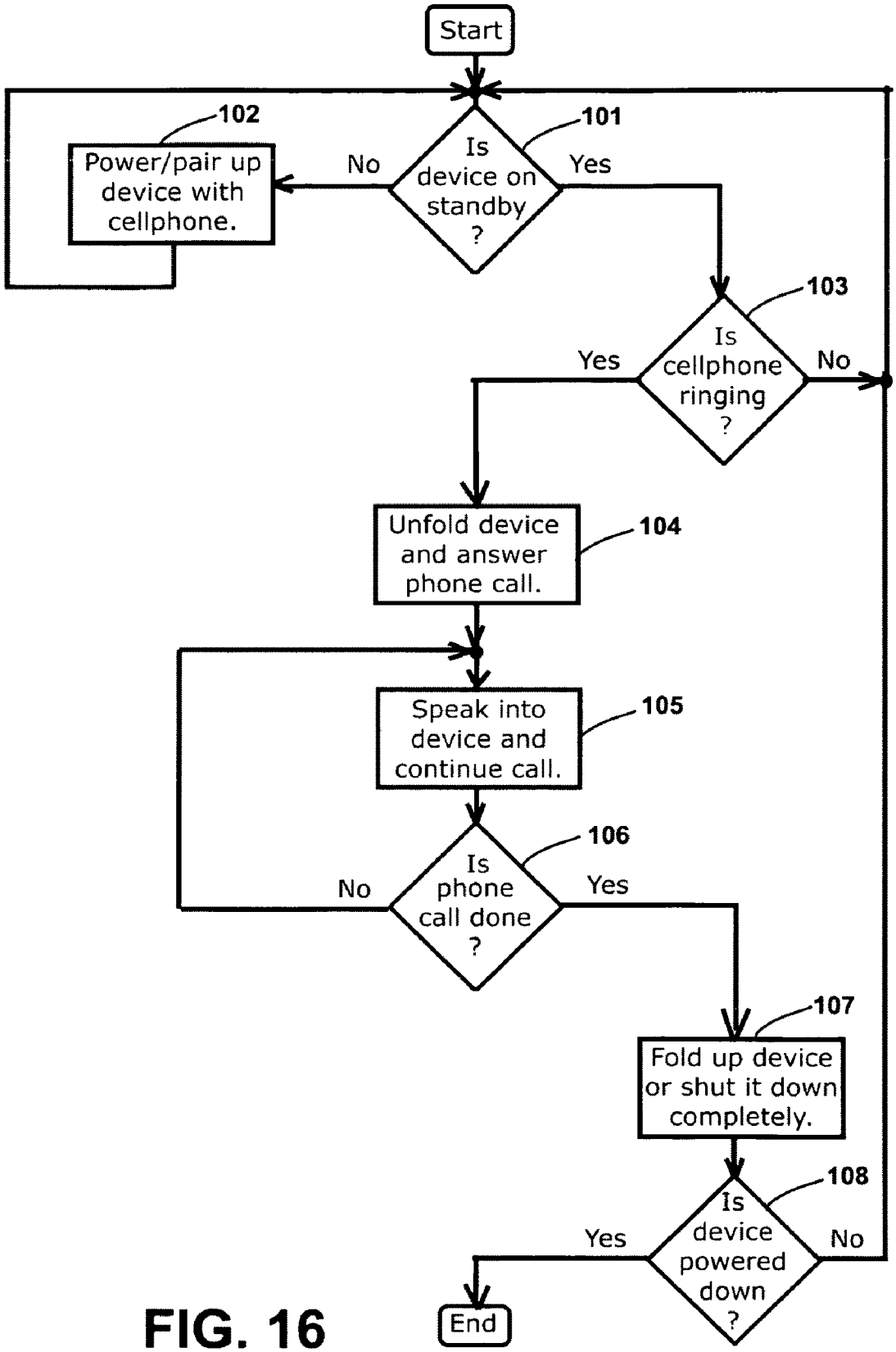
FIG. 16 is a flowchart of a typical operational mode of the wireless device in accordance with an embodiment of the current invention.

FIG. 16 illustrates the typical steps involved when a user wants to use the device 10, such as when answering a cellphone call. Step 101 checks to see if the device 10 is prepared for use by the user. An internal monitoring circuitry of the transceiver system 26 usually takes care of this task of ensuring that the device is powered up and paired with a cellphone, a state in which the device is in a standby mode. If it finds that the device is not in such mode then the user must perform the power up and pairing tasks, step 102, typically with the use of the multi-key 28, before proceeding any further. On the other hand, if the device 10 is determined to be ready, or in standby mode, and then the user needs to make or answer a call such as when the cellphone is ringing, step 103, he needs to open or unfold, step 104, the device 10 first and then talks inside, step 105, the device 10. He can listen to the incoming call either through a wireless headset 50, a speaker on the cellphone 60 or a corded earphone implemented in another embodiment of the invention. In the case where he is trying to make a call, he could use the cellphone's 60 keypad, or touchscreen, or vocal commands, or a combination thereof, to dial the desired phone number. The device 10 stays connected to the other party until the user decides to end the call, step 106, by either closing or folding the device 10 or shutting it down by depressing the multi-key 28 for a few seconds, shown in step 107. Finally, in step 108, if the device 10 was folded up, the device 10 will go into a standby mode whereby it resumes to listening or monitoring for any commands from the cellphone 60.

Figure 17:
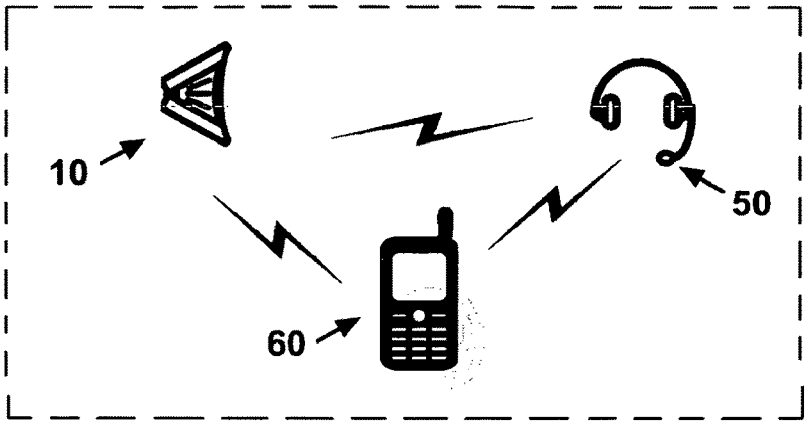
FIG. 17 is a diagram of a typical operational mode of the wireless device in accordance with an embodiment of the current invention.

FIG. 17 shows a diagram of an embodiment of the invention whereby the transmitter output of the device 10 is received by either a mobile phone 60 or with a wireless headset 50 or a combination thereof. The device 10 also receives wireless signals such as control, monitoring and management from a mobile phone 60 or a headset 50 or both. The mobile phone 60 generally connects to a cellphone service provider via a base station 70.

Figure 18:
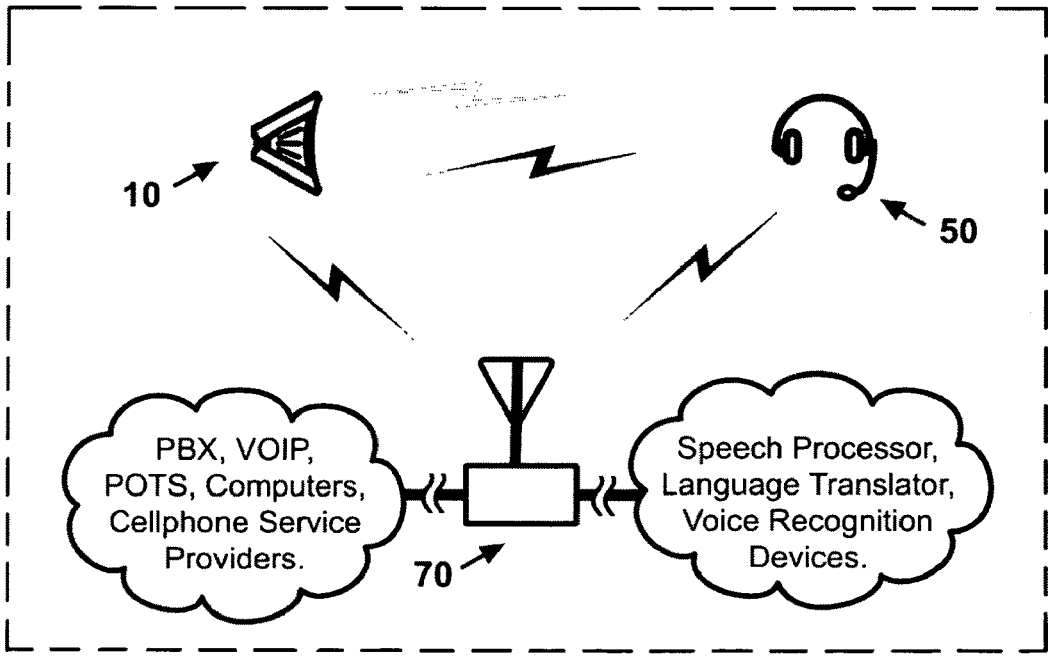
FIG. 18 is a diagram of another typical operational mode of the wireless device in accordance with an embodiment of the current invention.

FIG. 18 shows a diagram of the invention 10 telecommunicating with a wireless headset 50 and a wireless base station unit 70 that connects to a PC, a computer file server, a voice recognition system, a cellphone service provider, an automated language translation system, a transcription machine, other voice input processors and/or a combination thereof. The device 10 also receives wireless signals such as commands, control signals, monitoring and management signals from a base station 70 or a headset 50 or a combination thereof.

I claim:

1. A handheld passive noise silencing device comprising a first shell unit having an open end and a closed end, a second shell unit having an open end and a closed end, and a hinge that connects said first shell unit and said second shell unit at their closed ends defining a clamshell housing further comprising: a) a formable noise silencing interior housing having a wide open end and a closed with the wide open end adapted to enclose a user's mouth area; b) a microphone to receive a user's speech positioned inside or outside said interior housing; c) and a transceiver for processing and transmitting the output signal from said microphone and receiving and processing incoming signals.

2. The handheld passive noise silencing device according to claim 1 wherein said interior housing is removable.

3. The handheld passive noise silencing device according to claim 1 wherein said interior housing comprises a vent to relieve internal sound pressure.

4. The handheld passive noise silencing device according to claim 1 wherein said clamshell further comprises a supple material conforming to the brims of the open end units of said shell units that is removable or disposable or machine washable, or a combination thereof.

5. The handheld passive noise silencing device according to claim 1 wherein said clamshell housing further comprises a sensor or switch, or a combination thereof, associated with said transceiver.

6. The handheld passive noise silencing device according to claim 1 wherein said clamshell housing further comprises an earpiece associated with said transceiver to output received signals.

7. A handheld passive noise silencing device comprising a first shell unit having an open end and a closed end, a second shell-unit having an open end and a closed end, and a hinge that connects said first shell unit and said second shell unit at their closed ends defining a clamshell housing further comprising: a) a formable noise silencing interior unit having a wide open end and a closed with the wide open end adapted to enclose a user's mouth area; b) a microphone to receive a user's speech; c) a transceiver for processing and transmitting the audio signal from said microphone and receiving and processing incoming signals; d) and an earpiece associated with said transceiver to output said received signals.

8. The handheld passive noise silencing device according to claim 7 wherein said interior housing is removable.

9. The handheld passive noise silencing device according to claim 7, wherein said interior housing comprises a vent to relieve internal sound pressure.

10. The handheld passive noise silencing device to according to claim 7 wherein said clamshell housing having a means for varying the input or output signals to or from said transceiver.

11. The handheld passive noise silencing device according to claim 7, wherein said earpiece is wireless.

12. The handheld passive noise silencing device according to claim 7 further comprising a sensor or electronic circuitry or electrical circuitry, or combinations thereof, for activating or deactivating said device, said circuitry is generally associated with said transceiver.

13. A handheld passive noise silencing device comprising a first shell unit having an open end and a closed end, a second shell unit having an open end and a closed end, and a hinge that connects said first shell unit and said second shell unit at their closed ends defining a clamshell housing further comprising: a) a formable noise silencing interior unit having a wide open end and a closed with the wide open end adapted to enclose a user's mouth area; b) a microphone to receive a user's speech; c) a transceiver for processing and transmitting the audio signal from said microphone and receiving and processing incoming signals; d) a sound absorbing or noise abating material to reduce a user's vocal noise; e) and an earpiece associated with said transceiver to output said received signals.

14. The handheld passive noise silencing device according to claim 13 wherein said interior housing is removable.

15. The handheld passive noise silencing device according to claim 13 wherein said sound absorbing material is removable.

16. The handheld passive noise silencing device according to claim 13, wherein said formable interior housing comprises a vent to relieve internal sound pressure.

17. The handheld passive noise silencing device according to claim 13 wherein said clamshell further comprises a supple material conforming to the brims of the open end units of said shell units that is removable or disposable or machine washable, or a combination thereof.

18. The handheld passive noise silencing device to according to claim 13 wherein said clamshell housing having a means for varying the input or output signals to or from said transceiver.

19. The handheld passive noise silencing device according to claim 13, wherein said earpiece is wireless.

20. The handheld passive noise silencing device according to claim 13 further comprising a sensor or electronic circuitry or electrical circuitry, or combinations thereof, for activating or deactivating said device, said circuitry is generally associated with said transceiver and located in or on said clamshell housing.

* * * * *